US011795708B2

(12) United States Patent
McCracken et al.

(10) Patent No.: US 11,795,708 B2
(45) **Date of Patent: *Oct. 24, 2023**

(54) HEAVY DUTY SPANNING FORMS AND RELATED SYSTEMS AND METHODS

(71) Applicant: Wilian Holding Co., Des Moines, IA (US)

(72) Inventors: Robert McCracken, Urbandale, IA (US); Andrew Gray, Ankeny, IA (US)

(73) Assignee: Wilian Holding Co., Des Moines, IA (US)

( * ) Notice: Subject to any disclaimer, the term of this patent is extended or adjusted under 35 U.S.C. 154(b) by 72 days.

This patent is subject to a terminal disclaimer.

(21) Appl. No.: 17/176,589

(22) Filed: Feb. 16, 2021

(65) Prior Publication Data

US 2021/0164244 A1 Jun. 3, 2021

Related U.S. Application Data

(63) Continuation of application No. 16/440,379, filed on Jun. 13, 2019, now Pat. No. 10,920,433.

(60) Provisional application No. 62/684,444, filed on Jun. 13, 2018.

(51) Int. Cl.
*E04G 9/06* (2006.01)
*E04G 9/02* (2006.01)

(52) U.S. Cl.
CPC ..... *E04G 9/06* (2013.01); *E04G 2009/026* (2013.01)

(58) Field of Classification Search
CPC ..... E04G 11/10; E04G 11/12; E04G 11/16; E04G 2011/067; E04G 2009/023; E04G 2009/025; E04G 2009/028; E04G 9/06; E04G 2009/026
USPC ..... 248/189, 191, 192; 264/33
See application file for complete search history.

(56) References Cited

U.S. PATENT DOCUMENTS 1,117,519 A * 11/1914 Robertson ..... E04G 11/12 249/192
2,151,210 A * 3/1939 Jennings ..... E04G 11/062 249/195
2,703,003 A 3/1955 Ruppel
3,160,940 A * 12/1964 Jennings ..... E04G 17/0754 249/191
3,549,115 A * 12/1970 Williams ..... E04G 9/10 249/33

(Continued)

FOREIGN PATENT DOCUMENTS

CN 105952141 A * 9/2016 ..... E04G 9/02
CN 106639298 A * 5/2017 ..... E04G 9/06

(Continued)

OTHER PUBLICATIONS

Translation of CN 105952141 A. (Year: 2016).*

*Primary Examiner* — Michael Safavi
(74) *Attorney, Agent, or Firm* — Dentons Davis Brown; Kassandra Ricklefs

(57) ABSTRACT

A metal concrete form panel having a face sheet secured to a perimeter flange that includes side rails and end rails. One or more tie ribs extend between the end rails. A bolt block is secured in each corner to the perimeter flange where the side rails meet the end rails. A bar is located spaced inside each side rail and extended between and secured to each of the pair of opposing bolt blocks of the associated end rail and also secured to each intervening tie rib and to the face sheet.

15 Claims, 7 Drawing Sheets

(56) References Cited

U.S. PATENT DOCUMENTS 3,760,540 A 9/1973 Latoria et al.
3,899,155 A * 8/1975 Ward ..... E04G 11/10 249/189
4,210,305 A * 7/1980 Williams ..... E04G 9/02 249/165
4,239,173 A * 12/1980 Sawyer ..... E04G 17/06 249/190
4,964,256 A 10/1990 McCracken
4,975,009 A * 12/1990 Easton ..... E04G 17/045 249/192
5,058,855 A * 10/1991 Ward ..... E04G 17/04 249/168
5,065,558 A 11/1991 Boatsman
5,465,542 A 11/1995 Terry
5,509,635 A * 4/1996 Jaruzel ..... E04G 9/02 249/47
5,707,539 A * 1/1998 Flathau ..... E04G 11/10 249/189
5,792,552 A 8/1998 Langkamp et al.
6,148,575 A * 11/2000 Dingier ..... E04G 1/153 249/189
6,502,802 B2 * 1/2003 Jorn ..... E04G 11/087 249/192
6,581,898 B2 6/2003 McCracken
6,691,976 B2 * 2/2004 Myers ..... E04G 17/045 249/191
6,962,316 B2 * 11/2005 Ward ..... E04G 9/06 249/191
9,861,190 B2 * 1/2018 Lee ..... A47B 13/003
2002/0117598 A1 * 8/2002 Ward ..... E04G 17/045 249/47
2002/0117602 A1 * 8/2002 Ward ..... E04G 9/06 249/189
2004/0056172 A1 * 3/2004 Sedran ..... E04G 11/40 249/189
2004/0069925 A1 * 4/2004 Bartrum ..... E04G 9/06 249/18
2006/0157636 A1 * 7/2006 Bogensberger ..... E04G 9/06 249/189
2007/0028542 A1 2/2007 Lafferty, III et al.
2008/0128582 A1 * 6/2008 Serrano Rodriguez ..... E04G 11/10 249/26
2008/0307725 A1 * 12/2008 Trimmer ..... E04G 11/02 52/261
2009/0272876 A1 * 11/2009 McNamara ..... E04G 17/02 249/192
2010/0242403 A1 * 9/2010 Brewka ..... E04G 11/10 52/742.15
2011/0232218 A1 * 9/2011 Hynes ..... E04G 17/045 52/319
2012/0286134 A1 * 11/2012 Rojas Pimienta .. E04G 17/0652 249/192
2013/0025222 A1 1/2013 Mueller

FOREIGN PATENT DOCUMENTS

DE 2926780 * 1/1981 ..... E04G 11/10
DE 102015223764 A1 * 6/2017 ..... E04G 11/483
EP 2206855 A1 * 7/2010 ..... E04G 17/12
EP 3712351 A1 * 9/2020 ..... B23K 37/0443
ES 2284414 A1 * 11/2007 ..... E04G 17/042
GB 2057042 A * 3/1981 ..... E04G 17/075
JP 06212793 A * 8/1994 ..... E04G 2009/028
KR 2003024013 A * 3/2003 ..... E04G 9/05
KR 102151343 B1 * 9/2020 ..... E04G 9/02
WO WO-9106730 A1 * 5/1991 ..... E04G 9/04
WO WO-2019151576 A1 * 8/2019 ..... E04G 9/02
WO WO-2020201859 A1 * 10/2020 ..... E04G 9/04

* cited by examiner

HEAVY DUTY SPANNING FORMS AND RELATED SYSTEMS AND METHODS

CROSS-REFERENCE TO RELATED APPLICATION(S)

This application claims priority as a continuation of U.S. patent application Ser. No. 16/440,379, filed Jun. 13, 2019 and entitled "Heavy Duty Spanning Forms and Related Systems and Methods," which claims the benefit under 35 U.S.C. § 119(e) to U.S. Provisional Application 62/684,444, filed Jun. 13, 2018 and entitled "Bolt Bearing Block for Heavy Duty, Spanning Forms," both of which are hereby incorporated herein by reference in their entireties.

FIELD

This various embodiments herein relate generally to concrete forming systems and, more particularly, to steel forms for concrete construction, and even more specifically to a heavy duty spanning form panel having a bolt bearing block for connection to other heavy duty spanning form panels.

BACKGROUND

Concrete construction forms are generally prefabricated by the manufacturer for use in a particular structural application such as corner forms, linear wall forms, or form parts for assembly on the job to build concrete structures. Modular beam forming systems that span from support to support are well known in the industry. The term "modular form" means one of several form members that can be connected together to make a longer member. This invention is the method, mechanism, and/or device that increases the strength of the connection between the forms and hence the spanning capacity of the form system.

As mentioned above, there are modular beam forming systems that can span from support to support. The beam sides and soffit are formed using flat form panels bolted in a U-shaped configuration, while the side panels of the beam forming system are the members that span from support to support. The side forms have similarities to a wide flange beam, or at least they share terminology; there is a top flange, a bottom flange and a web that separates the flanges. Similar to wide flange beams, one flange will resist tension while the opposing flange will resist compression. The tension and compression flanges of adjacent modular form panels need to be connected to transfer the tension and compression forces. Each form panel has a welded connection at the corner of the panel that receives high strength bolts such that adjacent panels can be connected together. Typically, these connections consist of a steel bolting block, steel form panel face sheet, steel top or bottom member or flange, steel end rail of the modular form, and the weld that binds all these connection pieces together. In order to increase the spanning capacity of the form, it is generally understood that it is necessary to (1) increase the size and strength of the face sheet and top or bottom flange: (2) increase the amount of weld between these members and the bolt bearing block; and (3) increase the size and/or number of high strength bolts.

Known modular, spanning beam forms were originally invented in the early 1960's by EFCO Corp., and the original form is sold under the "Plate Girder" trademark. That original design has been copied by other form companies. This known form is a face sheet backed up by supporting members (also called "ribs") that connect to top and bottom "rails" often referred to as top and bottom flanges. Similar to wide flange beams, the face sheet is the web and the top and bottom rails are the top and bottom flanges of the spanning member. The top and bottom flanges resist tension or compression forces similar to the flanges in wide flange beams. The tensile and compressive forces in the flanges of the form need to be transferred to the adjacent panel by a bolted connection, which is provided by components on each of the two coupled forms that are referred to as "bolt bearing blocks" (or "bolt blocks"). On each form, the high strength bolts bear on the bolt blocks, which are steel blocks welded to the face sheet and the top or bottom flange. Generally, the spanning capacity is limited by the strength of the bolts and/or the strength of the bolt block connection.

When the known Plate Girder™ forming system was introduced in the mid-1960s, it was common to manufacture forms using steel with 36 ksi yield strength. Due to advances in steel production technologies, there is now a desire to manufacture form panels using steel with 50 KSI or higher yield strengths in an effort to increase the spanning capability of the form system without a corresponding increase in the weight of the form panels. One disadvantage to utilizing the higher strength steels is that the form panel components must be adequately stiffened—especially those components subjected to compression forces—in order for the components to be able to support the higher stresses due to the higher form panel loads. Higher loads also add to the loads that need to be resisted by the bolts and bolt bearing blocks. Further, in recent years, new, higher strength concrete formulations have been introduced and are becoming widely used in the construction of poured concrete structures. With higher strength concrete comes longer spans and the requirement for the formwork to be able to support the longer spans.

There is a need in the art for an improved modular concrete form panel with an improved form panel connection to address the disadvantages of the known form systems for spanning applications described above.

BRIEF SUMMARY

Discussed herein are various modular form panels for concrete construction having components that strengthen the panels and further enhance the load bearing capacity of the resulting form panel assembly.

In Example 1, a modular metal concrete form panel comprises a face sheet secured to a perimeter flange having side rails and end rails, a bolt block secured to the face sheet and further secured to the perimeter flange where the side rails meet the end rails, and a strengthening bar disposed inside each side rail at a distance from each side rail and extended between and secured to each of the pair of opposing bolt blocks of such end rail, wherein the strengthening bar is secured to the face sheet.

Example 2 relates to the form panel according to Example 1, wherein the perimeter flange comprises a lip disposed on the side rails and the end rails.

Example 3 relates to the form panel according to Example 2, wherein the bolt block comprises a protrusion disposed in a notch defined in the lip of the end rails, whereby the bolt block is secured directly to the side rail and the lip of the side rail.

Example 4 relates to the form panel according to Example 1, further comprising at least one rib disposed between the end rails and attached at one end to a first of the side rails and at another end to a second of the side rails.

Example 5 relates to the form panel according to Example 4, wherein the strengthening bar is disposed through the at least one rib and attached thereto.

Example 6 relates to the form panel according to Example 4, further comprising at least one cross rib attached at a first end to the at least one rib and attached at a second end to one of the end rails.

In Example 7, a modular form panel for concrete construction comprises a face sheet, a flange disposed around a perimeter of the face sheet, the flange comprising first and second opposing side rails and first and second opposing end rails, four bolt blocks attached to the face sheet, the first and second side rails, and the first and second end rails, wherein each of the four bolt blocks is disposed in a separate corner of the face sheet, at least one rib disposed between and parallel with the first and second end rails and attached at a first end to the first side rail and at a second end to the second side rail, a first reinforcement bar disposed between and parallel with the first and second side rails and attached at a first end to a first of the four bolt blocks and at a second end to a second of the four bolt blocks, and a second reinforcement bar disposed between and parallel with the first and second side rails and attached at a first end to a third of the four bolt blocks and at a second end to a fourth of the four bolt blocks.

Example 8 relates to the form panel according to Example 7, wherein each of the first and second side rails and the first and second end rails comprises a lip disposed thereon.

Example 9 relates to the form panel according to Example 8, wherein a first notch is defined between a first end of the lip of the first end rail and the first side rail, a second notch is defined between a second end of the lip of the first end rail and the second side rail, a third notch is defined between a first end of lip of the second end rail and the first side rail, and a fourth notch is defined between a second end of the lip of the second end rail and the second side rail.

Example 10 relates to the form panel according to Example 9, wherein a first of the four bolt blocks comprises a first protrusion disposed in the first notch, wherein the first bolt block is attached to the first side rail and the lip of the first side rail, a second of the four bolt blocks comprises a second protrusion disposed in the second notch, wherein the second bolt block is attached to the second side rail and the lip of the second side rail, a third of the four bolt blocks comprises a third protrusion disposed in the third notch, wherein the third bolt block is attached to the first side rail and the lip of the first side rail, and a fourth of the four bolt blocks comprises a fourth protrusion disposed in the fourth notch, wherein the fourth bolt block is attached to the second side rail and the lip of the second side rail.

Example 11 relates to the form panel according to Example 7, wherein the first and second reinforcement bars are disposed through a notch defined in the at least one rib and are attached to the at least one rib.

Example 12 relates to the form panel according to Example 7, wherein the first reinforcement bar is disposed at a distance from the first side rail such that the first reinforcement bar is closer to the first side rail than the second side rail, and the second reinforcement bar is disposed at a distance from the second side rail such that the second reinforcement bar is closer to the second side rail than the first side rail.

Example 13 relates to the form panel according to Example 7, wherein the first end of the first reinforcement bar is attached to an end of the first bolt block that is opposite an end of the first bolt block attached to the first side rail, the second end of the first reinforcement bar is attached to an end of the second bolt block that is opposite and end of the second bolt block attached to the first side rail, the first end of the second reinforcement bar is attached to an end of the third bolt block that is opposite an end of the third bolt block attached to the second side rail, and the second end of the second reinforcement bar is attached to an end of the fourth bolt block that is opposite an end of the fourth bolt block attached to the second side rail.

Example 14 relates to the form panel according to Example 7, further comprising at least one cross rib attached at a first end to the at least one rib and attached at a second end to one of the first and second end rails.

In Example 15, a method of constructing a concrete spanning beam comprises positioning at least first and second modular form panels adjacent to each other. Each of the first and second modular form panels comprises a face sheet, a flange disposed around a perimeter of the face sheet, the flange comprising first and second opposing side rails and first and second opposing end rails, four bolt blocks attached to the face sheet, the first and second side rails, and the first and second end rails, wherein each of the four bolt blocks is disposed in a separate corner of the face sheet, at least one rib disposed between and parallel with the first and second end rails and attached at a first end to the first side rail and at a second end to the second side rail, a first reinforcement bar disposed between and parallel with the first and second side rails and attached at a first end to a first of the four bolt blocks and at a second end to a second of the four bolt blocks, and a second reinforcement bar disposed between and parallel with the first and second side rails and attached at a first end to a third of the four bolt blocks and at a second end to a fourth of the four bolt blocks. The method further comprises aligning the first modular form panel with the second modular form panel such that the first end rail of the first modular form panel is in contact with the second end rail of the second modular form panel, positioning at least two bolts through at least two holes in a first of the four bolt blocks of the first modular form panel and through at least two holes in a first of the four bolt blocks of the second modular form panel, thereby attaching the first bolt block of the first modular form panel with the first bolt block of the second modular form panel, positioning at least two bolts through at least two holes in a second of the four bolt blocks of the first modular form panel and through at least two holes in a second of the four bolt blocks of the second modular form panel, thereby attaching the second bolt block of the first modular form panel with the second bolt block of the second modular form panel, and attaching a plurality of additional modular form panels to the first or second form panels or additional attached form panels by repeating the aligning and the positioning of the at least two bolts to create a panel assembly.

Example 16 relates to the method according to Example 15, further comprising attaching the panel assembly to first and second supports such that the panel assembly is disposed on and supported by the first and second supports.

Example 17 relates to the method according to Example 16, further comprising pouring concrete into the panel assembly to form a concrete structure that extends across and is supported by the first and second supports.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The various embodiments herein relate to a metal concrete form panel having an increased resistance to deflection and bending when coupled with other such panels to contain and form and support concrete spanning structures. In certain implementations, the form panel as described herein displays an increase in strength of up to at least 200%, and in some cases, 300%, in comparison to known form panels.

Figure 1:
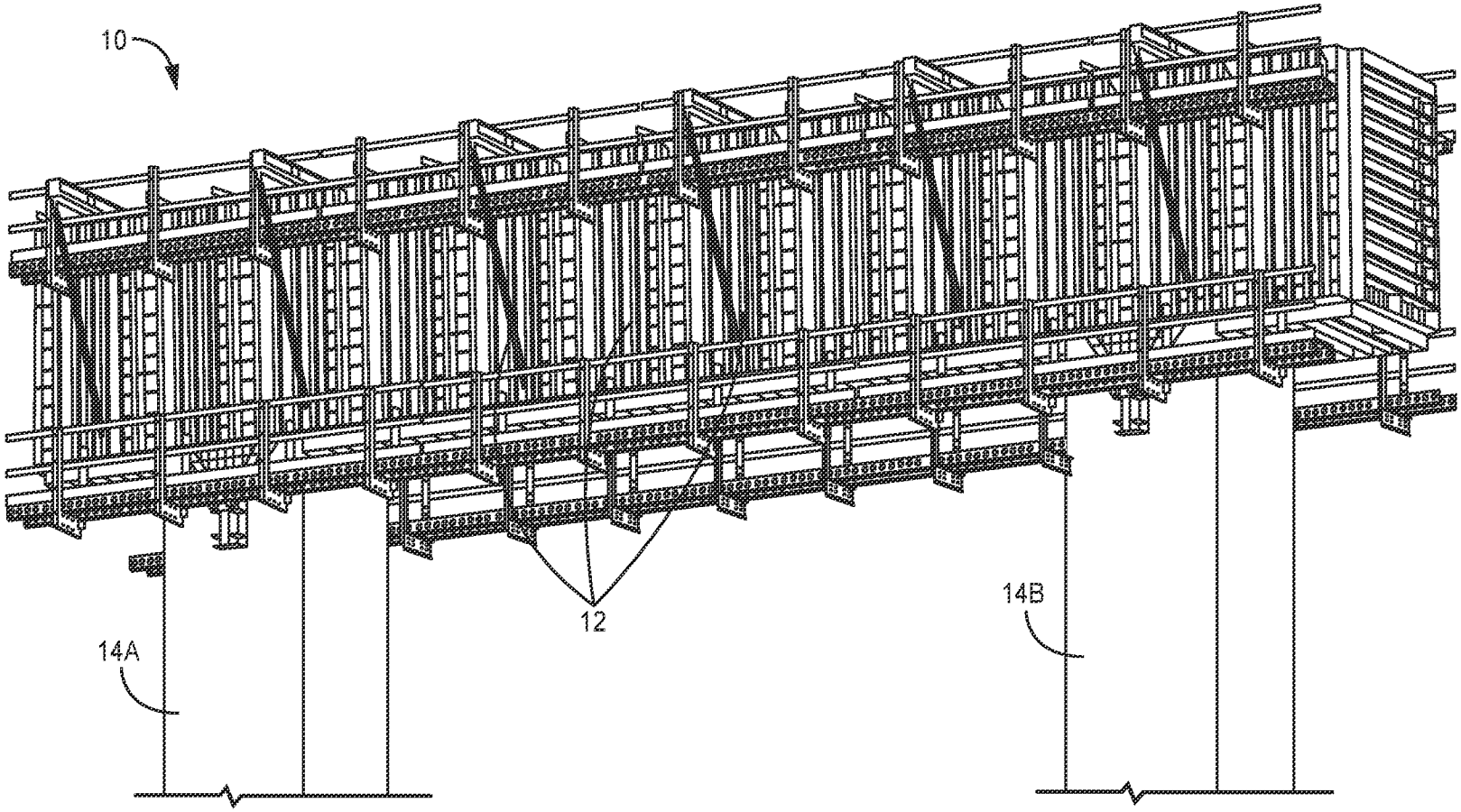
FIG. 1 is a perspective view of a integrated concrete form component made up of a plurality of concrete form panels, according to one embodiment.

FIG. 1 depicts an integrated concrete form panel assembly 10 that is made up of a plurality of form assembly 10 that have been assembled or coupled together for the construction of a concrete structure. More specifically, the integrated form panel assembly 10 spans from one support 14A to another support 14B such that the panel assembly 10 allows for pouring a concrete structure that cures such that it extends across and is supported by both supports 14A, 14B.

One exemplary implementation of a metal concrete form panel 20 is depicted in FIGS. 2-7. The form panel 20 has a face sheet 22 and a perimeter flange 24 that extends from a rear side of the face sheet 22 (as best shown in FIGS. 3-7). The flange 24 extends from the back side of the face sheet 22 around the entire perimeter of the face sheet 22 and is made up of a pair of opposing side rails 26*a* and 26*b* and a pair of opposing end rails 28*a* and 28*b*. It is understood that the flange 24 (or the rails 26*a*, 26*b*, 28*a*, 28*b*) are secured to the face sheet 22 by weldments or similar attachment mechanism or methods. According to certain embodiments, the flange 24 (that is, each of the rails 26*a*, 26*b*, 28*a*, 28*b*) has a lip disposed thereon. More specifically, as best shown in FIGS. 2, 3, 4, 6, and 7, the side rails 26*a*, 26*b* have a lip 27 and the end rails 28*a*, 28*b* have a lip 29. The lips 27, 29 may also be referred to herein as "formed returns."

Figure 2:
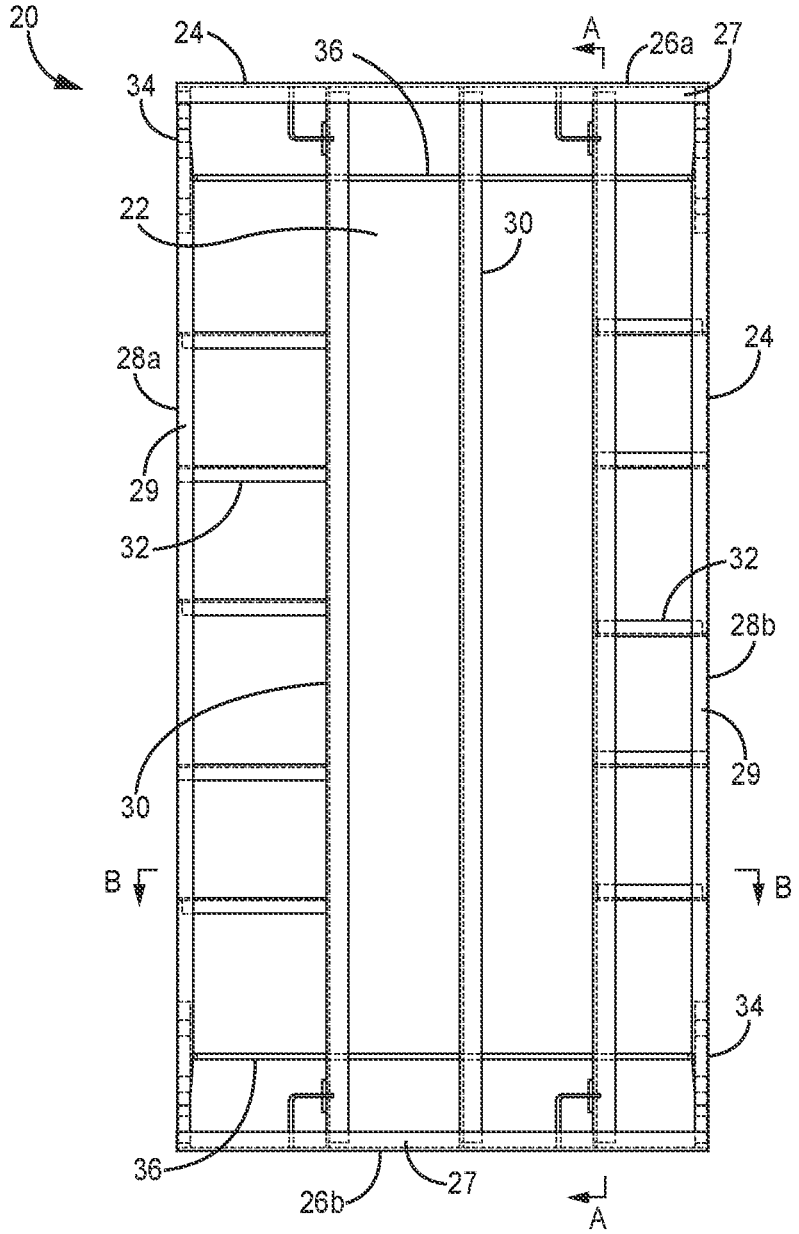
FIG. 2 is an elevation view of a rear side of a modular concrete form component, according to one embodiment.
Figure 3:
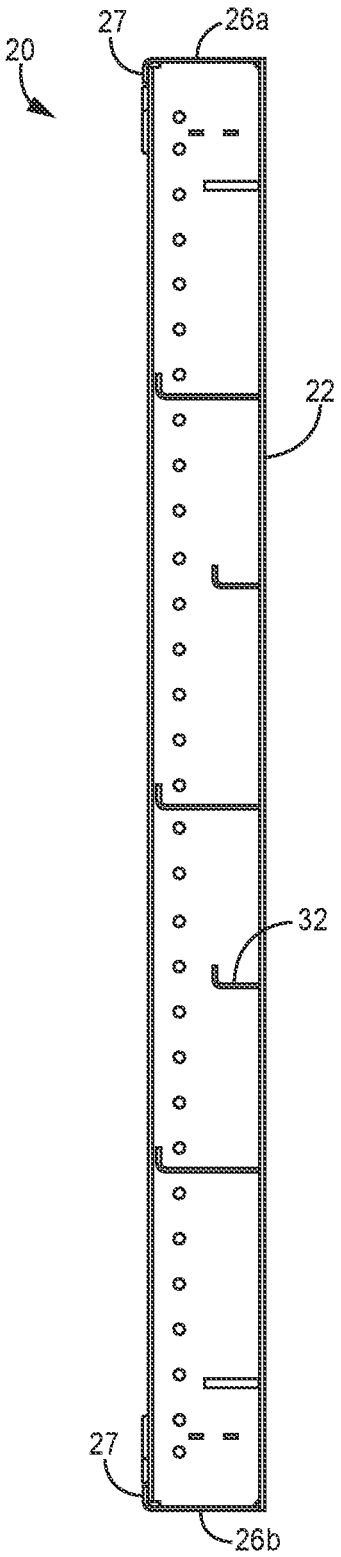
FIG. 3 is a cross-sectional view taken along line A-A of FIG. 2, according to one embodiment.

As best shown in FIG. 2, the panel 20 also has ribs 30 and rib stiffeners (or "cross ribs") 32 attached thereto. More specifically, the panel 20 has one or more ribs 30 that are disposed on the same side of the face sheet 22 as the side rails 26*a*, 26*b* and extend between the side rails 26*a*, 26*b* and are parallel with the end rails 28*a*, 28*b*. Each rib 30 is secured along its length by weldments or the like to the back side of the face sheet 22 and further is attached at its ends to the side rails 26*a*, 26*b*. In addition, the panel 20 has at least two rib stiffeners 32, each of which is a short member (by comparison to a rib 30, for example) that extends between a tie rib 30 and one of the end rails 28*a*, 28*b* as shown such that the rib stiffeners 32 are parallel to the side rails 26*a*, 26*b*. Each cross rib 32 is secured along its length to the back side of the face sheet 22 by weldments or the like and further is attached at its ends to a rib 30 on one end and one of the end rails 28*a*, 28*b* on the other.

Figure 4:
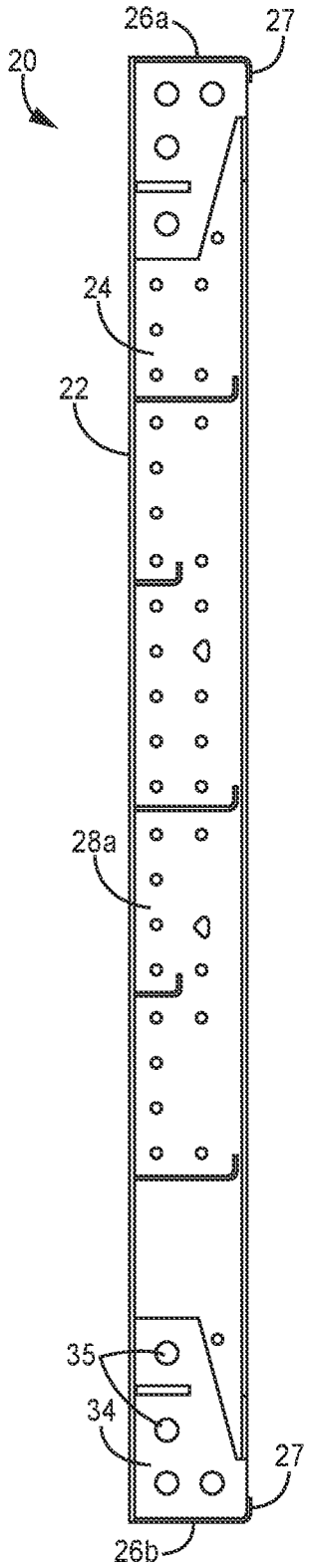
FIG. 4 is a side view of the panel of FIG. 2, according to one embodiment.
Figure 5:
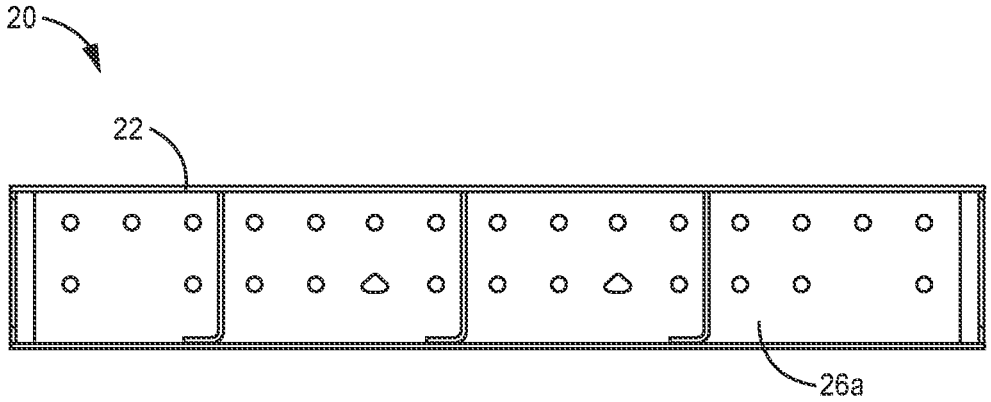
FIG. 5 is a plan or top view of the panel of FIG. 2, according to one embodiment.
Figure 6:
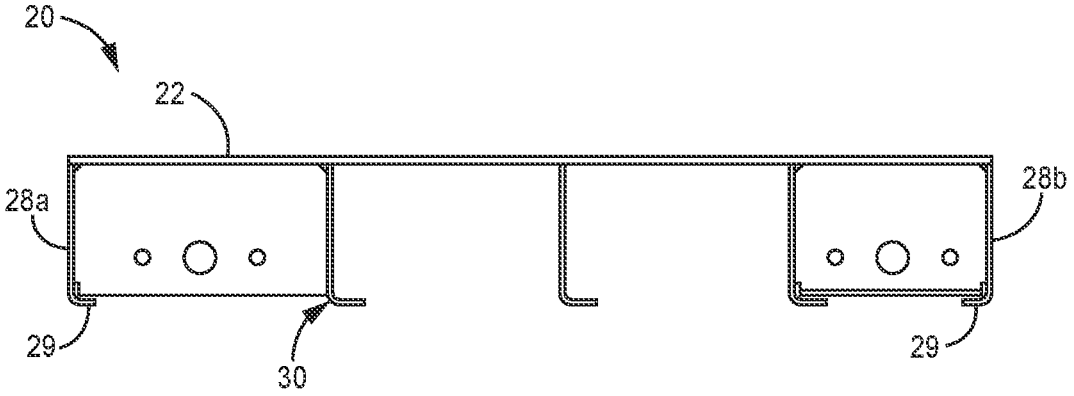
FIG. 6 is a cross-sectional view taken along line B-B of FIG. 2, according to one embodiment.
Figure 7:
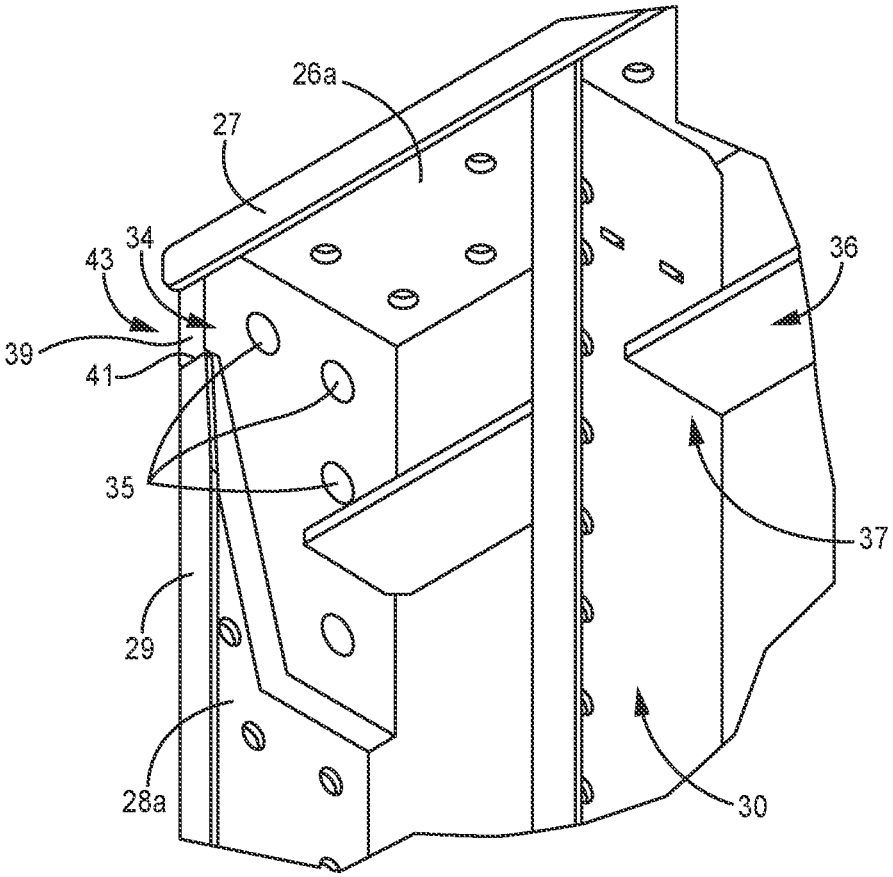
FIG. 7 is an expanded perspective view of a bolt block, according to one embodiment.

As best shown in FIGS. 2, 4, and 7, in accordance with one implementation, the form panel 20 also has four bolt blocks 34—one in each corner of the panel 20. Each bolt block 34 is used in conjunction with a corresponding bolt block on a second, adjacent form to secure the instant form 20 to the adjacent form via bolts that are coupled to both of the corresponding blocks. Thus, the bolt blocks 34 on the form 20 and the bolt blocks on the adjacent forms (not shown) operate together to secure multiple form panels 20 together in a fashion similar to that shown in FIG. 1. Each bolt block 34 functions to transfer forces between and among the multiple form panels 20, thereby giving the form system 10 (the plurality of panels 20) its bending moment strength. As best shown in FIGS. 4 and 7, each bolt block 34 is a piece of metal 34 that is disposed in a corner of the panel 20 and secured along a side to one of the end rails 28*a*, 28*b* and at its end to one of the side rails 26*a*, 26*b*. Further, each bolt block 34 has at least two openings 35 defined therein that are configured to receive the bolts (not shown) that couple to the bolt block 34 and the corresponding bolt block on the adjacent form (not shown).

In one embodiment, the openings 35 in any of the bolt block 34 implementations disclosed or contemplated herein are sized to receive 1¼ inch bolts (not shown). Alternatively, the openings 35 can be sized to receive 1 inch bolts (not shown). In a further implementation, the openings 35 can be sized to receive any known bolt of any known size that is used for coupling form panels in concrete construction. In certain embodiments, each block 34 has four openings 35 and thus couples to an adjacent block 34 on an adjacent panel 20 via four bolts (not shown). Alternatively, the coupling could occur using three bolts (not shown). In a further alternative, two bolts (not shown) could be used. It is understood that the bolt block 34 can have two, three, four, or more openings 35 for receiving bolts (not shown).

In addition, according to one embodiment, the panel 20 also has two strengthening bars (or "support bars" or "reinforcement bars") 36 as best shown in FIGS. 2 and 7 that extend between two bolt blocks 34 at a spaced distance from (and parallel to) the closest side rail 26*a*, 26*b* as shown. Each of the bars 36 is secured, for example by weldments, at opposite ends of the bar 36 to each of the bolt blocks 34. In one embodiment, the bar 36 is attached to the two bolt blocks 34 at the point on each block 34 that is farthest from the side rail 26*a*, 26*b* to which the block 34 is attached. Further, as best shown in FIG. 7, each bar 36 extends through an opening (or "slot") 37 defined in each of the ribs 30 disposed between the two bolt blocks 34 and is secured to each such rib 30 by weldments or the like. In addition, the strengthening bar 36 is also attached to the face sheet 22, and can be attached by weldments or other known attachment methods or mechanisms. According to one implementation, each strengthening bar helps to prevent the face sheet 22, and thus the entire panel 20, from buckling near the compression flange, thereby resulting in a larger compression zone of the form 20 being able to resist more load. It is understood that, because the various panel embodiments (such as, for example, panel 20) disclosed or contemplated herein are modular panels, the location of the compression flange (along with the compression and tension zones discussed below) on the panel (such as panel 20) depends on how the loads are applied to the form assembly (and thus the individual, modular panels). Additionally, according to certain embodiments, each strengthening bar 36 can increase the area of the tension zone, thereby increasing the tensile flange capacity of the panel 20. Further, each strengthening bar 36 adds significant strength to the bolt bearing blocks 34 to which it is attached. That is, the bar 36 adds the necessary strength to the bolt blocks 34 to allow more, larger diameter high strength bolts, thereby increasing the strength of the connection between panels. This, in turn, increases the spanning capacity of the entire form system (like form system 10, for example).

In accordance with certain implementations, each bolt bearing block 34, such as, for example, the bolt bearing block 34 as shown in FIG. 7, has a protrusion 39 that extends out from the block 34 such that it is disposed adjacent to and "flush" with the lip 29 of the end rail 28*a* as shown. In other words, a portion of the lip 29 is removed such that an end 41 of the lip 29 is disposed at a distance from the side rail 26*a*, thereby defining a notch 43 formed between the lip end 41 and the side rail 26*a*. The protrusion 39 is disposed within the notch 43 and is attached (by a weld in one exemplary embodiment) directly to the lip 27 of side rail 26*a*. This configuration of the protrusion 39 disposed in the notch 43 and attached to the lip 27 results in a greater percentage of the bolt loading being transferred directly to the main structural components of the concrete form panel, thereby resulting in a more rigid bolt bearing block connection than prior connection designs. The prior, known connection designs have a bolt bearing block that is typically a simple bar that does not protrude into the notch in the end rail lip, which results in some of the bolt loading being indirectly transferred to the structural components of the panel, which can ultimately result in too much load being placed on those structural components.

Figure 8A:
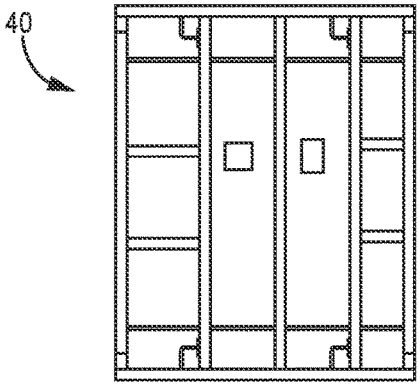
FIGS. 8A-8D are elevation views of various exemplary form panels of different sizes, according to certain embodiments.
Figure 8B:
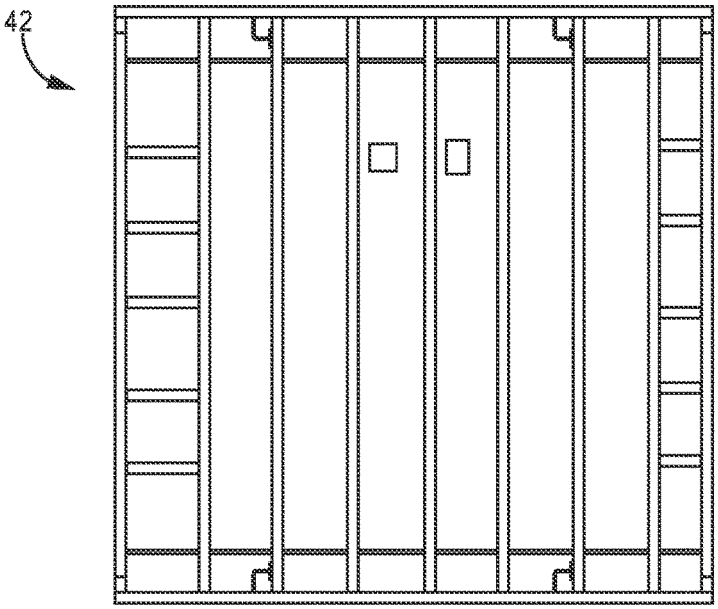
Figure 8C:
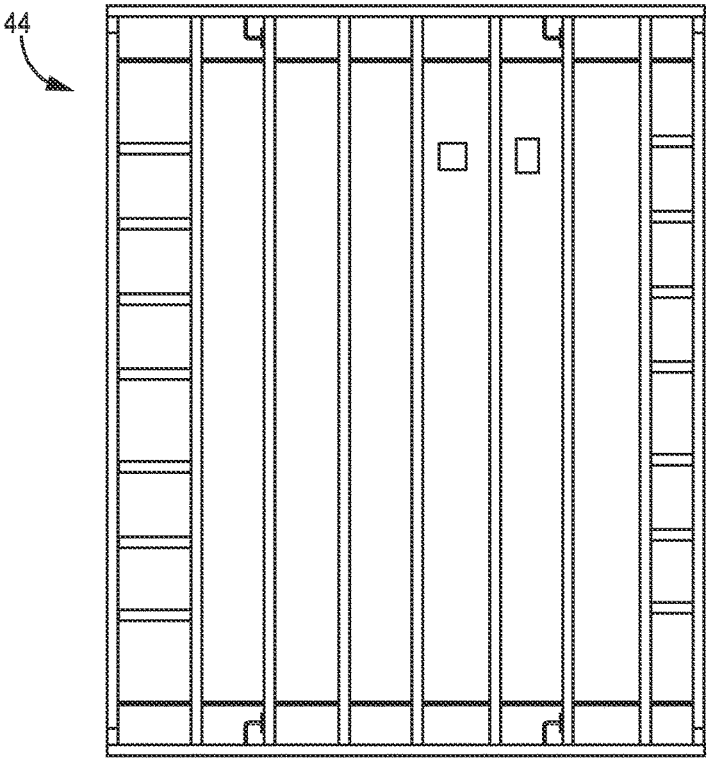
Figure 8D:
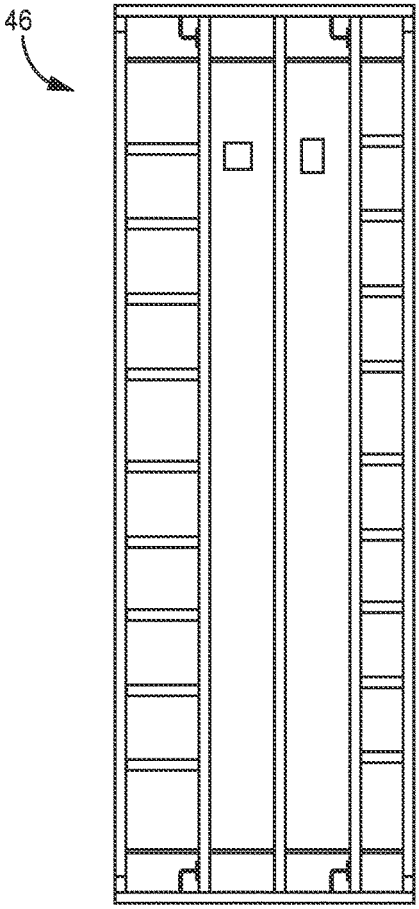

It is understood that any form panel according to any embodiment disclosed or contemplated herein can be of any size desired for use in the concrete forming industry. Various exemplary sizes and configurations are depicts in FIGS. 8A-8D. While the various configurations as shown in these FIGS. 8A-8D can have any known dimensions, specific examples are also provided herein. For example, the form panel 40 as depicted in FIG. 8A can be 5 feet by 4 feet. Further, in another example, the form panel 42 shown in FIG. 8B can be 8 feet by 8 feet. Additionally, a further example is shown in FIG. 8C, in which the panel 44 is 10 feet by 8 feet. Another example is depicted in FIG. 8D, in which the panel 46 is 4 feet by 12 feet. It is understood that any known dimensions for any known panels can be used for the various panels 40, 42, 44, 46 depicted in FIGS. 8A-8D.

In a further specific example, Table 1 sets forth a chart of various panel sizes, including certain more common sizes identified with an "X."

TABLE 1

| | X1' | X2' | X4' | X6' | X8' | X12' |
|---|---|---|---|---|---|---|
| 2'R | | | | | | |
| 3'R | | | | | | |
| 4'R | | | | | | |

TABLE 1-continued

| | X1' | X2' | X4' | X6' | X8' | X12' |
|---|---|---|---|---|---|---|
| 5'R | X | X | X | | X | X |
| 6'R | X | X | X | | X | X |
| 7'R | X | X | X | | X | X |
| 8'R | X | X | X | | X | X |
| 9'R | X | X | X | | X | |
| 10'R | X | X | X | | X | |
| 12'R | X | X | X | | X | |

Figure 9A:
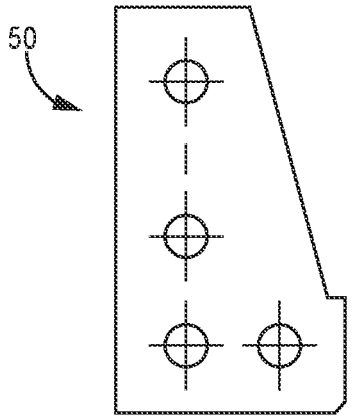
FIGS. 9A-9C are expanded side views of various exemplary bolt blocks of different sizes that can be used in various form panel embodiments of different sizes, according to certain embodiments.
Figure 9B:
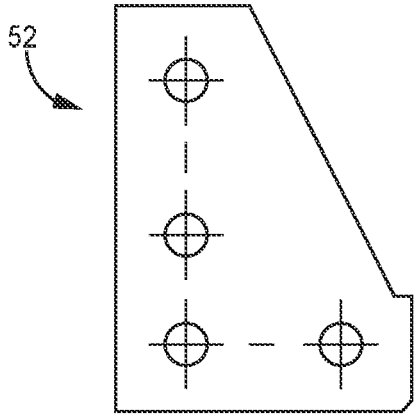
Figure 9C:
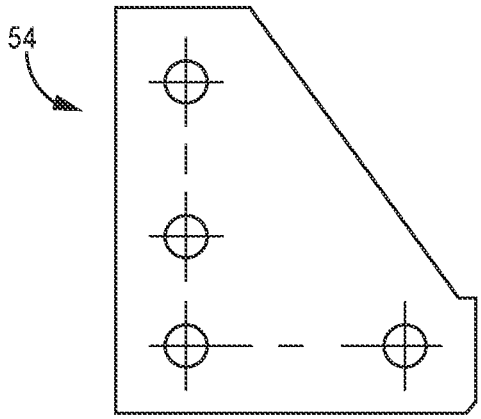

As shown in FIGS. 9A-9C, It is understood that any bolt block according to any embodiment disclosed or contemplated herein can be of any size as necessary to fit within or be incorporated into the form panels of various sizes as described above for use in the concrete forming industry. Various exemplary sizes and configurations of the bolt blocks are depicted in FIGS. 9A-9C. For example, bolt block 52 of FIG. 9B is wider than bolt block 50 as shown in FIG. 9A. Further, bolt block 54 depicted in FIG. 9C is wider than bolt block 52 of FIG. 9B. It is understood that the various bolt blocks (such as blocks 34, 50, 52, 54) vary in size to accommodate the increased loading of larger form panels 20. Further, it is understood that the larger bolt blocks as contemplated herein can include additional bolt holes for additional or larger bolts.

The foregoing description and drawings comprise illustrative embodiments of the various embodiments. The foregoing implementations described herein may vary based on the ability, experience, and preference of those skilled in the art. The foregoing description and drawings merely explain and illustrate the embodiments, and the various implementations are not limited thereto, except insofar as the claims are so limited. Those skilled in the art who have the disclosure before them will be able to make modifications and variations therein without departing from the scope of the inventions.

What is claimed is:

1. A modular metal panel for forming concrete structures, the panel comprising:

(a) a face sheet secured to a perimeter flange having side rails and end rails;

(b) two bolt blocks secured to the face sheet, wherein each of the two bolt blocks is secured to the perimeter flange in opposing corners of the form panel where the side rails meet the end rails; and (c) a strengthening bar disposed inside each side rail at a distance from each side rail and extended between and secured at a first end to a first of the two bolt blocks and at a second end to a second of the two bolt blocks, wherein the strengthening bar is secured to the face sheet.

2. The form panel of claim 1, wherein the perimeter flange comprises a lip disposed on the side rails and the end rails.

3. The form panel of claim 1, wherein each of the bolt blocks is secured directly to one of the side rails.

4. The form panel of claim 1, further comprising at least one rib disposed between the end rails and attached at one end to a first of the side rails and at another end to a second of the side rails.

5. The form panel of claim 4, wherein the strengthening bar is disposed through the at least one rib and attached thereto.

6. The form panel of claim 4, further comprising at least one cross rib attached at a first end to the at least one rib and attached at a second end to one of the end rails.

7. A modular form panel for concrete construction, the form panel comprising:

(a) a face sheet;

(b) a flange disposed around a perimeter of the face sheet, the flange comprising first and second opposing side rails and first and second opposing end rails;

(c) four bolt blocks attached to the face sheet, the first and second side rails, and the first and second end rails, wherein each of the four bolt blocks is disposed in a separate corner of the face sheet;

(d) at least one rib attached at a first end to the first side rail and at a second end to the second side rail;

(e) a first reinforcement bar disposed between and parallel with the first and second side rails and attached at a first end to a first of the four bolt blocks and at a second end to a second of the four bolt blocks; and (f) a second reinforcement bar disposed between and parallel with the first and second side rails and attached at a first end to a third of the four bolt blocks and at a second end to a fourth of the four bolt blocks.

8. The form panel of claim 7, wherein each of the first and second side rails and the first and second end rails comprises a lip disposed thereon.

9. The form panel of claim 8, wherein a first notch is defined between a first end of the lip of the first end rail and the first side rail, a second notch is defined between a second end of the lip of the first end rail and the second side rail, a third notch is defined between a first end of lip of the second end rail and the first side rail, and a fourth notch is defined between a second end of the lip of the second end rail and the second side rail.

10. The form panel of claim 9, wherein the first bolt block is attached to the first side rail, the second bolt block is attached to the second side rail, the third bolt block is attached to the first side rail, and the fourth bolt block is attached to the second side rail.

11. The form panel of claim 7, wherein the first and second reinforcement bars are disposed through a notch defined in the at least one rib and are attached to the at least one rib.

12. The form panel of claim 7, wherein the first reinforcement bar is disposed at a distance from the first side rail such that the first reinforcement bar is closer to the first side rail than the second side rail, and the second reinforcement bar is disposed at a distance from the second side rail such that the second reinforcement bar is closer to the second side rail than the first side rail.

13. The form panel of claim 7, wherein the first end of the first reinforcement bar is attached to an end of the first bolt block that is opposite an end of the first bolt block attached to the first side rail, the second end of the first reinforcement bar is attached to an end of the second bolt block that is opposite an end of the second bolt block attached to the first side rail, the first end of the second reinforcement bar is attached to an end of the third bolt block that is opposite an end of the third bolt block attached to the second side rail, and the second end of the second reinforcement bar is attached to an end of the fourth bolt block that is opposite an end of the fourth bolt block attached to the second side rail.

14. The form panel of claim 7, further comprising at least one cross rib attached at a first end to the at least one rib and attached at a second end to one of the first and second end rails.

15. A modular form panel for concrete construction, the form panel comprising:

(a) a face sheet;

(b) a flange disposed around a perimeter of the face sheet, the flange comprising first and second opposing side rails and first and second opposing end rails;

(c) four bolt blocks attached to the face sheet, the first and second side rails, and the first and second end rails, wherein each of the four bolt blocks is disposed in a separate corner of the face sheet and comprises at least one opening configured to receive a bolt;

(d) at least one rib attached at a first end to the first side rail and at a second end to the second side rail;

(e) a first reinforcement bar attached at a first end to a first of the four bolt blocks and at a second end to a second of the four bolt blocks; and (f) a second reinforcement bar attached at a first end to a third of the four bolt blocks and at a second end to a fourth of the four bolt blocks.

* * * * *